US009878726B2

(12) United States Patent
Hoffmann et al.

(10) Patent No.: US 9,878,726 B2
(45) Date of Patent: Jan. 30, 2018

(54) CARRYING STRUCTURE OF A RAIL VEHICLE

(71) Applicant: Siemens AG Oesterreich, Vienna (AT)

(72) Inventors: Thilo Hoffmann, Graz (AT); Herfried Kaltenegger, Graz (AT); Armin Schank, Graz (AT)

(73) Assignee: Siemens AG Österreich, Vienna (AT)

( * ) Notice: Subject to any disclaimer, the term of this patent is extended or adjusted under 35 U.S.C. 154(b) by 172 days.

(21) Appl. No.: 14/785,559

(22) PCT Filed: Apr. 16, 2014

(86) PCT No.: PCT/EP2014/057682
§ 371 (c)(1),
(2) Date: Oct. 19, 2015

(87) PCT Pub. No.: WO2014/173743
PCT Pub. Date: Oct. 30, 2014

(65) Prior Publication Data

US 2016/0107658 A1 Apr. 21, 2016

(30) Foreign Application Priority Data

Apr. 23, 2013 (AT) ..... A 50279/2013

(51) Int. Cl.
*B61F 1/14* (2006.01)

(52) U.S. Cl.
CPC ..... *B61F 1/14* (2013.01)

(58) Field of Classification Search
CPC ..... B61F 1/08; B61F 1/14; B61F 5/00
See application file for complete search history.

(56) References Cited

U.S. PATENT DOCUMENTS 805,105 A * 11/1905 Timmis ..... B61F 5/22 105/171
1,438,837 A * 12/1922 Leboucher ..... B61F 5/14 105/453
1,645,271 A * 10/1927 Alben ..... B61F 1/14 105/199.1
2,861,522 A * 11/1958 Rossell ..... B61C 9/50 105/171

(Continued)

FOREIGN PATENT DOCUMENTS

CA 950272 7/1974
DE 20 55 220 7/1972

(Continued)

OTHER PUBLICATIONS

Office Action dated Oct. 9, 2016 which issued in the corresponding Chinese Patent Application No. 201480023218.7.

*Primary Examiner* — Jason C Smith
(74) *Attorney, Agent, or Firm* — Cozen O'Connor

(57) ABSTRACT

A carrying structure of a rail vehicle upon which a carriage body is supported by coupling elements, where at least one coupling element is connected to the carrying structure via a positive and/or non-positive connection, and where at least a part of the carrying structure below or above the connection or at least one surface upwardly delimiting the coupling element is configured as a supporting element such that the coupling element can be attached at any desired location on the rail vehicle with little effort.

15 Claims, 4 Drawing Sheets

(56) References Cited

U.S. PATENT DOCUMENTS

| | | | | |
|---|---|---|---|---|
| 3,757,702 | A * | 9/1973 | Kreissig | B61F 1/14 105/199.2 |
| 4,723,491 | A * | 2/1988 | von Madeyski | B61F 5/08 105/198.7 |
| 2012/0240813 | A1* | 9/2012 | Becher | B61F 5/52 105/157.1 |
| 2016/0264155 | A1* | 9/2016 | Kamura | B61F 5/10 |
| 2016/0362120 | A1* | 12/2016 | Ma | B61F 5/24 |

FOREIGN PATENT DOCUMENTS

| | | |
|---|---|---|
| DE | 8535955 | 2/1986 |
| EP | 1391331 | 2/2004 |
| FR | 481 789 | 1/1917 |
| GB | 403 782 | 1/1934 |
| GB | 708 066 | 4/1954 |
| WO | WO 2013029924 | 3/2013 |

* cited by examiner

-- Prior Art --

CARRYING STRUCTURE OF A RAIL VEHICLE

CROSS-REFERENCE TO RELATED APPLICATIONS

This is a U.S. national stage of application No. PCT/EP2014/057682 filed 16 Apr. 2014. Priority is claimed on Austrian Application No. A50279/2013 filed 23 Apr. 2013, the content of which is incorporated herein by reference in its entirety.

BACKGROUND OF THE INVENTION

1. Field of the Invention

The invention relates to a carrying structure of a rail vehicle, upon which a carriage body is supported by coupling elements, where at least one coupling element is connected to the carrying structure via a positive and/or non-positive connection.

2. Description of the Related Art

With rail vehicles, wheel wear results in a reduction in the height of the position of the carriage body.

When the rail vehicle pulls into a station, it may therefore occur that the level of a floor disposed in the carriage body comes to lie below the floor level of the station. The level difference between the station and the floor upper edge of the carriage body may result in the formation of a step in the transition region between the floor disposed in the carriage body and the floor of the station. These steps represent a significant safety risk for passengers. As a result, there is a need to raise the carriage body relative to its carrying structure to balance out the loss in height caused by the wheel wear. To this end, shims are placed below or above the coupling elements supporting the carriage body. This procedure is referred to as attaching a coupling element.

In accordance with the prior art, assembly of the shims occur via stationary or mobile lifting systems or via cranes, which are supported on the ground. Here, the carriage body is lifted via the lifting system until the coupling element is completely relieved of force. Here, the weight of the carriage body is transferred directly onto the ground. The shims can then be placed below or above the force-relieved coupling element. To this end, a corresponding workshop infrastructure or expensive mobile lifting systems is/are required.

The lifting systems are supported on the ground. A result, a solid and preferably smooth ground is required, which withstands the developing stresses due to the weight of the rail vehicle.

Assembly of the shims can thus often only be performed in a workshop with a corresponding workshop infrastructure. This is associated with considerable outlay.

SUMMARY OF THE INVENTION

In view of the foregoing, it is an object of the invention to provide a carrying structure of a rail vehicle, in which the coupling elements can be attached without any great effort. This and other objects and advantages are achieved in accordance with the invention by providing a carrying structure in which at least part of the carrying structure below or above the connection or at least one surface upwardly delimiting the coupling element is configured as a supporting element.

A lifting apparatus is supported against the supporting element, by which the carriage body is lifted with respect to the ground. Shims can be placed in a gap developing here between the coupling element and the carrying structure or between the carrying structure and the carriage body.

Therefore in contrast to the conventional lifting systems, assembly of the shims can also be performed at locations that do not have a solid ground, such as on a section of gravel track, because the lifting apparatus is not supported on the ground. A workshop infrastructure with an expensive lifting system is also not required to assemble the shims.

The invention therefore provides for a carrying structure of a rail vehicle, in which the coupling elements can be attached without any great effort and without the need for a complicated workshop infrastructure.

The coupling element has a longitudinal axis, where in a preferred embodiment of the carrying structure the supporting element is arranged coaxially with respect to this longitudinal axis.

In a special embodiment, part of the carrying structure below the connection that is formed as a supporting element is a balcony-shaped mold of the carrying structure.

In a further embodiment, the part of the carrying structure below the connection that is formed as a supporting element is the delimiting of a blind hole in the carrying structure.

In another embodiment of the inventive carrying structure, the part of the carrying structure below the connection that is formed as a supporting element is formed as a thread of a bore hole in the carrying structure.

The bore hole in the carrying structure can be formed as a continuous bore hole through the carrying structure or as a blind hole.

In another embodiment, the lifting apparatus can be or is supported on the supporting element.

The lifting apparatus can be arranged for instance in a blind hole or in the bore hole in the carrying structure or between the coupling element and the carriage body or in the coupling element or in a lower region of the carriage body. The lifting apparatus can also be arranged permanently at the said positions.

This is thus advantageous in that the coupling element can be attached at any desired location on the rail vehicle.

The lifting apparatus may include a hydraulic or mechanical drive unit or electrical drive unit or pneumatic drive unit for power generation.

For instance, the mechanical drive unit can be formed as a spindle and the hydraulic drive unit can be formed for instance as a piston of a hydraulic cylinder.

The coupling element is preferably a secondary spring of the rail vehicle. The secondary spring supports the carriage body on the carrying structure.

The secondary spring can be formed as a hydraulic spring, as a helical spring or a pneumatic spring.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE EXEMPLARY EMBODIMENTS

Figure 1:
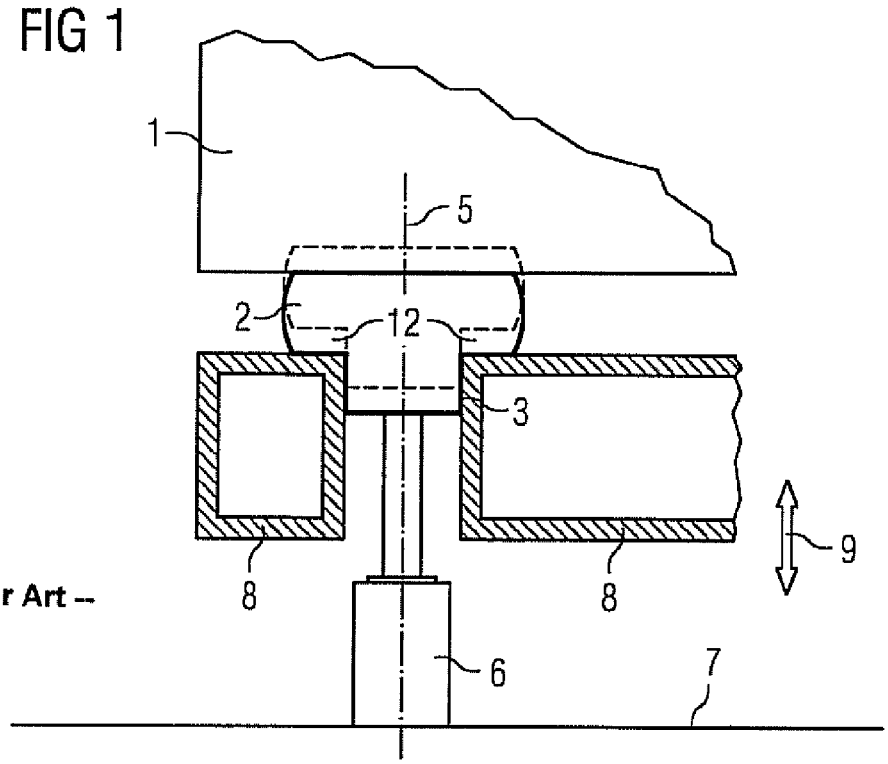
FIG. 1 is an exemplary schematic illustration of a section through a carrying structure in accordance with the prior art.

FIG. 1 is an exemplary schematic illustration of a section through a carrying structure 8 in accordance with the prior art. A cutout of a carrying structure 8 of a rail vehicle is shown, upon which a carriage body 1 is supported by a coupling element 2. The coupling element 2 is connected to the carrying structure 8 via a positive and/or non-positive connection 3. The connection 3 is provided by the limit surface between the lower, pin-shaped part of the coupling element 2 and the vertically oriented subarea of the carrying structure 8, which rests on the pin-shaped part of the coupling element 2. In order to attach the coupling element 2, the coupling element 2, together with the carriage body 1, is raised by a lifting apparatus 6. The raised coupling element 2 is shown with a dashed line in FIG. 1. The carriage body 1 is also raised when the coupling element 2 is raised.

A gap 12 develops between the coupling element 2 and the carrying structure 8. A shim is placed into this gap 12, then the coupling element 2, together with the carriage body 1, is lowered again. The directions 9 of the raising and lowering are oriented in parallel to a longitudinal axis 5 of the coupling element 2. The lifting apparatus 6 rests against the ground 7 when the coupling element 2 is raised and lowered.

Figure 2:
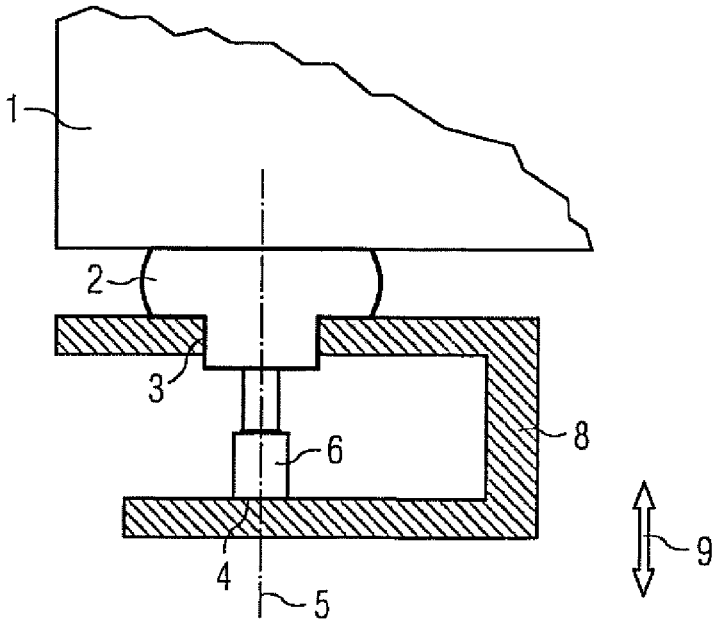
FIG. 2 is an exemplary schematic illustration of a section through a carrying structure with a balcony-shaped mold of the carrying structure in accordance with the invention.

FIG. 2 is an exemplary schematic illustration of a section through a carrying structure 8 with a balcony-shaped mold of the carrying structure 8 in accordance with the invention. A cutout of a carrying structure 8 of a rail vehicle is shown, upon which a carriage body 1 is supported via a coupling element 2. The coupling element 2 is connected to the carrying structure 8 by a positive and/or non-positive connection 3. The connection 3 is provided by the limit surface between the lower, pin-shaped part of the coupling element 2 and the vertically oriented subarea of the carrying structure 8, which rests against the pin-shaped part of the coupling element 2. In order to attach the coupling element 2, the coupling element 2, together with the carriage body 1, is raised by the lifting apparatus 6. Therefore in accordance with FIG. 1, a gap 12 (not shown in FIG. 2 for the sake of clarity) is formed between the coupling element 2 and the carrying structure 8. A shim is placed into this gap 12, then the coupling element 2, together with the carriage body 1, is lowered again. Part of the carrying structure 8 is formed below the connection 3 as a supporting element 4. At the point at which the carrying structure 8 is formed as a supporting element 4, the lifting apparatus 6 is supported in the directions 9 during the raising and lowering.

Figure 3:
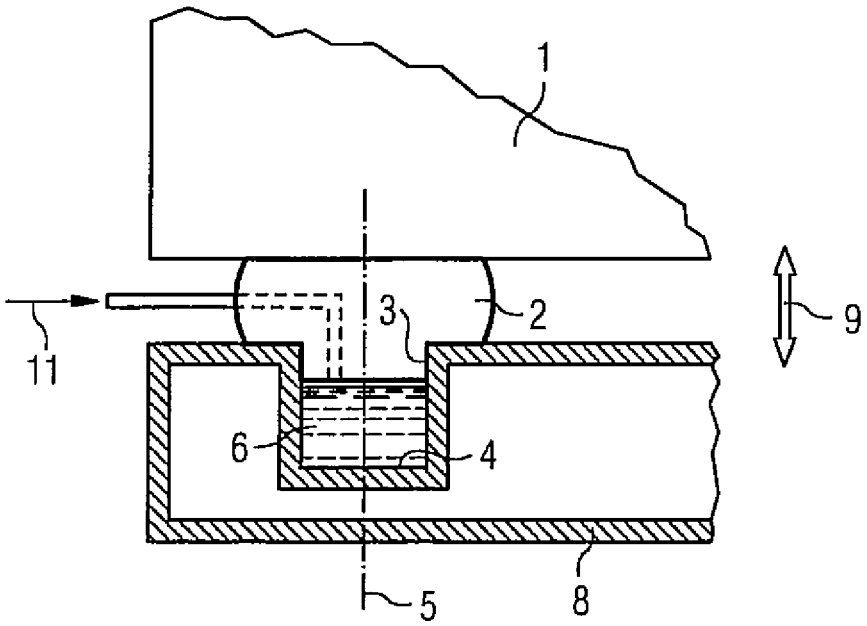
FIG. 3 is an exemplary schematic illustration of a section through a carrying structure with a blind hole in the carrying structure in accordance with an embodiment of the invention.

FIG. 3 is an exemplary schematic illustration of a section through a carrying structure 8 with a blind hole in the carrying structure 8 in accordance with an embodiment of the invention. A cutout of a carrying structure 8 of a rail vehicle, upon which a carriage body 1 is supported by a coupling element 2, is shown. The coupling element 2 is connected to the carrying structure 8 via a positive and/or non-positive connection 3. The connection 3 is provided by the limit surface between the lower, pin-shaped part of the coupling element 2 and the vertically oriented subarea of the carrying structure 8, which rests against the pin-shaped part of the coupling element 2. In order to attach the coupling element 2, the coupling element 2, together with the carriage body 1, is raised by a lifting apparatus 6. Part of the carrying structure 8 below the connection 3, precisely the delimitation of the blind hole in the carrying structure 8, is formed as a supporting element 4. In the embodiment shown, the blind hole is filled with a fluid 11. If the fluid 11 is pumped into the blind hole, the coupling element 2 is raised. If the fluid 11 is drained from the blind hole, the coupling element 2 is lowered. By raising the coupling element 2, together with the carriage body 1, according to FIG. 1, a gap 12 (not shown in FIG. 3 for purposes of clarity) is produced between the coupling element 2 and the carrying structure 8. A shim is placed into this gap 12, then the coupling element 2 together with the carriage body 1 is lowered again. The directions 9 of the raising and lowering are oriented in parallel to a longitudinal axis 5 of the coupling element.

Figure 4:
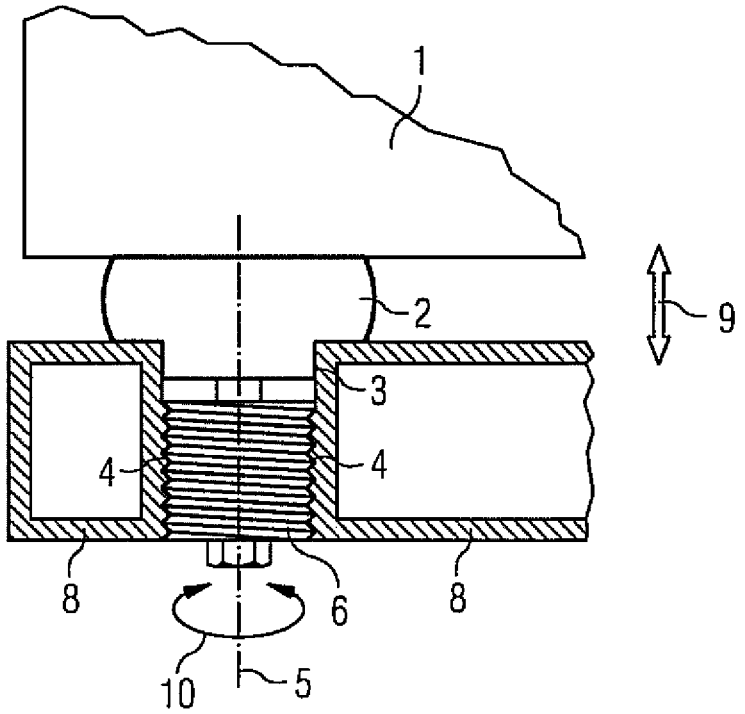
FIG. 4 is an exemplary schematic illustration of a section through a carrying structure with a bore hole through the carrying structure in accordance with an embodiment of the invention.

FIG. 4 is an exemplary schematic illustration of a section through carrying structure with a bore hole through the carrying structure 8 in accordance with an embodiment of the invention. A cutout of a carrying structure 8 of a rail vehicle is shown, upon which a carriage body 1 is supported by a coupling element 2. The coupling element 2 is connected to the carrying structure 8 via a positive and/or non-positive connection 3. The connection 3 is provided by the limit surface between the lower, pin-shaped part of the coupling element 2 and the vertically oriented subarea of the support structure 8, which rests on the pin-shaped part of the coupling element 2.

In order to attach the coupling element 2, the coupling element 2, together with the carriage body 1, is raised by a lifting apparatus 6. By raising the coupling element 2, together with the carriage body 1, according to FIG. 1, a gap 12 (not shown in FIG. 4 for purposes of clarity) is formed between the coupling element 2 and the carrying structure 8. A shim is placed into this gap 12, then the coupling element 2, together with the carriage body 1, is lowered again. The directions 9 of the raising and lowering are oriented in parallel with a longitudinal axis 5 of the coupling element. The lifting apparatus 6 is formed as a spindle in the embodiment shown. The part of the carrying structure 8 which is formed as a supporting element 4 is a thread, which is arranged below the connection 3.

A rotation of the spindle in the directions of rotation 10 causes a translation movement of the spindle oriented parallel to the longitudinal axis 5 of the coupling element in the directions 9, as a result of which, depending on the direction of rotation 10 either a raising or a lowering of the coupling element 2 and the carriage body 1 occurs.

Figure 5:
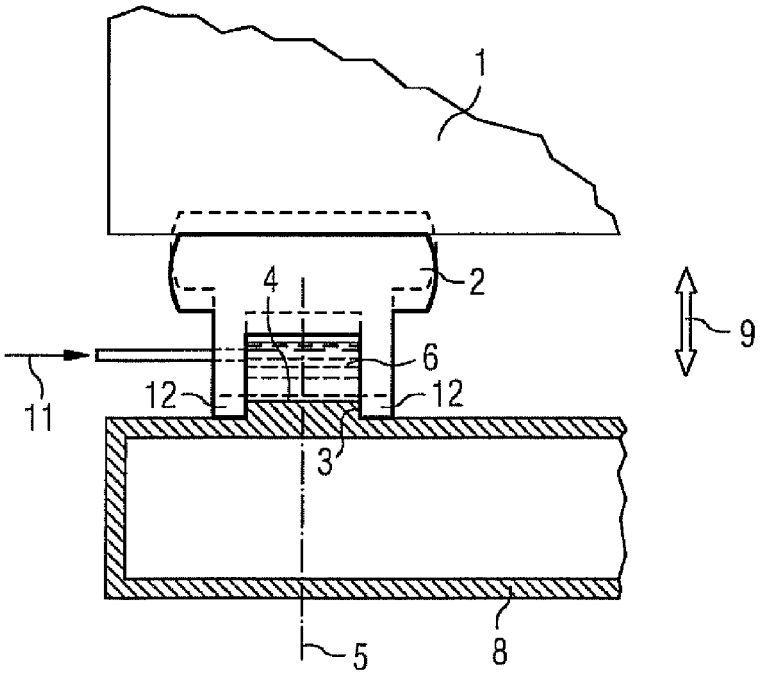
FIG. 5 is an exemplary schematic illustration of a section through a carrying structure with a pin fixed to the carrying structure in accordance with an embodiment of the invention.

FIG. 5 is an exemplary schematic illustration of a section through a carrying structure 8 with a pin fixed to the carrying structure 8 in accordance with an embodiment of the invention. A cutout of a carrying structure 8 of a rail vehicle is shown, upon which a carriage body 1 is supported by a coupling element 2. The coupling element 2 is connected to the carrying structure 8 by a positive and/or non-positive connection 3. The connection 3 is provided by the limit surface between the vertically oriented outer surface of the pin of the carrying structure 8 and the inner vertically oriented subarea of the coupling element 2, which rests against the vertically oriented outer surface of the pin. In order to attach the coupling element 2, the coupling element 2, together with the carriage body 1, is raised by a lifting apparatus 6, which is formed here as a hydraulic lifting apparatus 6.

The part of the carrying structure 8 that is arranged above the connection 3, precisely the front face of the pin fixed to the carrying structure 8, is formed as a supporting element 4. In the embodiment shown, the space enclosed by the coupling element 2 and the front face of the pin is filled with a fluid 11. If fluid 11 is pumped into this space, the coupling element 2 is raised. If fluid 11 is drained out of the space, the coupling element 2 is lowered. By raising the coupling element 2, together with the carriage body 1, a gap 12 is formed between the coupling element 2 and the carrying structure 8. The raised coupling element 2 is indicated with the dashed line. A shim is placed into this gap 12, then the coupling element 2, together with the carriage body 1, is lowered again. The directions 9 of the raising and lowering are oriented in parallel to a longitudinal axis 5 of the coupling element.

Figure 6:
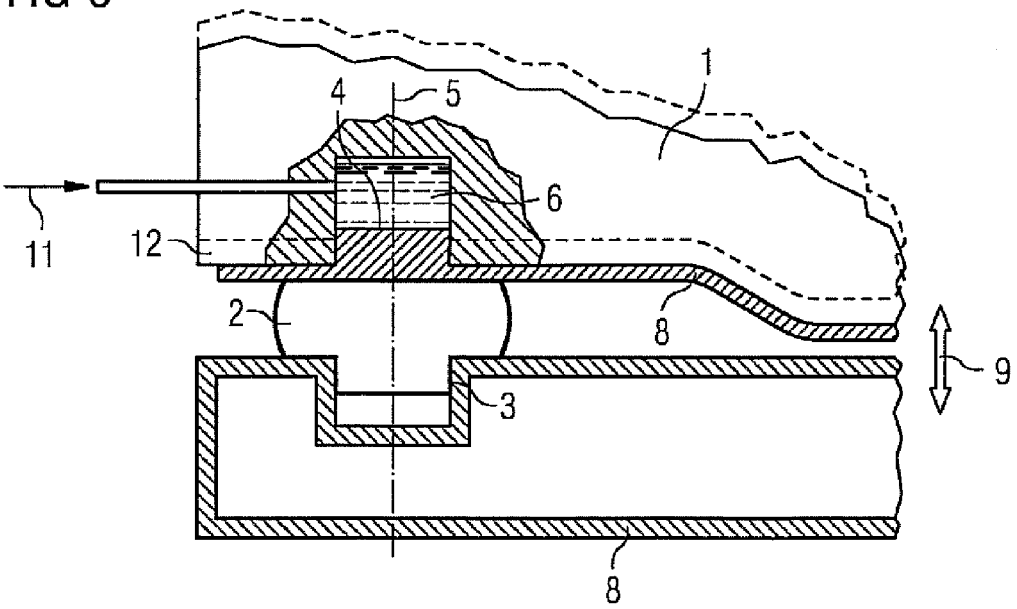
FIG. 6 is an exemplary schematic illustration of a section through a carrying structure with a lifting apparatus arranged in the carriage body in accordance with an embodiment of the invention.

FIG. 6 is an exemplary schematic illustration of a section through a carrying structure 8 with a lifting apparatus 6 arranged in the carriage body 1 in accordance with an embodiment of the invention. A cutout of a carrying structure 8 of a rail vehicle, upon which a carriage body 1 is supported by a coupling element 2, is shown. The coupling element 2 is connected to the carrying structure 8 via a positive and/or non-positive connection 3. The connection 3 is provided by the limit surface between the lower, pin-shaped part of the coupling element 2 and the vertically oriented subarea of the carrying structure 8, which rests on the pin-shaped part of the coupling element 2. The upper part of the carrying structure 8 is formed as a traverse. A pin is fixed to the traverse, as shown similarly in FIG. 5. The upper part of the carrying structure 8, which is arranged above the connection 3, precisely the front face of the pin fixed to the traverse, is formed as a supporting element, upon which the lifting apparatus 6 is supported. In the embodiment shown here, the space enclosed by the carriage body 1 and the pin fixed to the traverse is filled with a fluid 11 and forms the lifting apparatus 6.

If fluid 11 is pumped into this space, the carriage body is raised with respect to the traverse. If fluid 11 is drained from the space, the carriage body is lowered. By raising the carriage body 1, a gap 12 is formed between the traverse and the carriage body 1. The raised carriage body 1 is indicated with the dashed line. A shim is placed into this gap 12, then the carriage body 1 is lowered again. The directions 9 of the raising and lowering are oriented in parallel to a longitudinal axis 5 of the coupling element.

Figure 7:
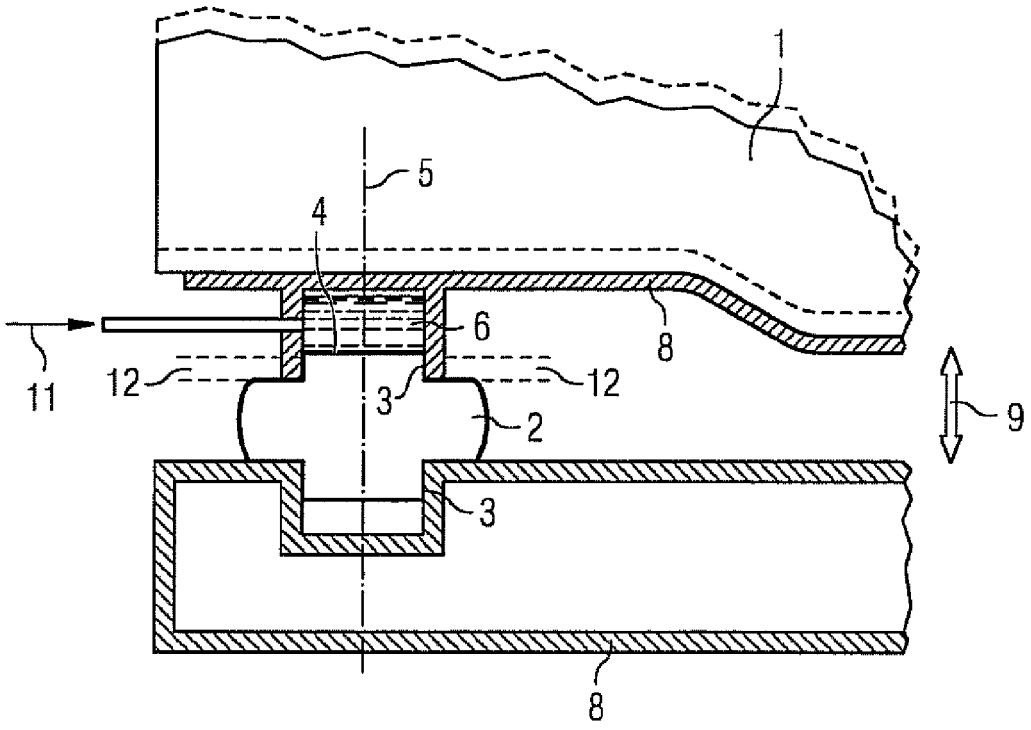
FIG. 7 is an exemplary schematic illustration of a section through a carrying structure with a lifting apparatus arranged between the coupling element and the carriage body in accordance with an embodiment of the invention.

FIG. 7 is an exemplary schematic illustration of a section through a carrying structure 8 with a lifting apparatus 6 arranged between the coupling element 2 and the carriage body 1 in accordance with an embodiment of the invention. The upper part of the carrying structure 8 is formed as a traverse, where the carriage body 1 is supported on the lower part of the carrying structure 8 by the coupling element 2. A surface that upwardly delimits the coupling element 2 is formed as a supporting element 4, upon which the lifting apparatus 6 is supported. The coupling element 2 is connected on both sides to the carrying structure 8 by a positive and/or non-positive connection 3. In precise terms, the connection 3 is provided, on the one hand by, the limit surface between the lower pin-shaped part of the coupling element 2 and the vertically oriented subarea of the carrying structure 8, which rests on the pin-shaped part of the coupling element 2 and, on the other hand, by the limit surface between the upper pin-shaped part of the coupling element 2 and the vertically oriented subarea of the traverse. In the embodiment shown here, the space formed by the vertically oriented subarea of the traverse and the upper pin-shaped part of the coupling element 2 is filled with a fluid 11 and forms the lifting apparatus 6. If fluid 11 is pumped into this space, the carriage body 1, together with the traverse, is raised in respect of the coupling element 2. If fluid 11 is drained from the space, the carriage body 1 or the traverse is lowered. By raising the carriage body 1 or the traverse, a gap 12 is forced between the coupling element 2 and the front face of the vertically oriented subarea of the traverse. The raised carriage body 1 is indicated by the dashed line. A shim is placed into this gap 12, then the carriage body 1 or the traverse is lowered again. The directions 9 of the raising and lowering are oriented in parallel with a longitudinal axis 5 of the coupling element.

The inventive carrying structure 8 is configured such that the weight of the carriage body 1 is always directly or indirectly supported on the carrying structure 8 during the raising and lowering of the carriage body 1. The coupling element 2 can thus be attached at any desired location on the rail vehicle with little effort.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A carrying structure of a rail vehicle, comprising:

at least one coupling element arranged below a carriage body such that the carriage body is supported by the at least one coupling element;

at least one of a positive connection and a non-positive connection connecting the at least one coupling element to the carrying structure;

wherein at least a part of the carrying structure disposed below or above at least one of the positive connection and the non-positive connection or at least one surface upwardly delimiting the coupling element is configured as a supporting element.

2. The carrying structure as claimed in claim 1, wherein the at least one coupling element has a longitudinal axis, and wherein the supporting element is arranged coaxially with respect to the longitudinal axis of the at least one coupling element.

3. The carrying structure as claimed in claim 2, wherein the part of the carrying structure disposed below at least one of the positive connection and the non-positive connection , which is formed as a supporting element, is formed as a thread of a bore hole in the carrying structure.

4. The carrying structure as claimed in claim 2, wherein that the part of the carrying structure disposed below at least one of the positive connection and the non-positive connection, which is formed as the supporting element, is a balcony-shaped mold of the carrying structure.

5. The carrying structure as claimed in claim 2, wherein the part of the carrying structure disposed below at least one of the positive connection and the non-positive connection, which is formed as the supporting element, is a delimitation of a blind hole in the carrying structure.

6. The carrying structure as claimed in claim 1, wherein that the part of the carrying structure disposed below at least one of the positive connection and the non-positive connection, which is formed as the supporting element, is a balcony-shaped mold of the carrying structure.

7. The carrying structure as claimed in claim 1, wherein the part of the carrying structure disposed below at least one of the positive connection and the non-positive connection, which is formed as the supporting element, is a delimitation of a blind hole in the carrying structure.

8. The carrying structure as claimed in claim 1, wherein the part of the carrying structure disposed below at least one of the positive connection and the non-positive connection, which is formed as a supporting element, is formed as a thread of a bore hole in the carrying structure.

9. The carrying structure as claimed in claim 1, wherein a lifting apparatus is supportable or supported on the supporting element.

10. The carrying structure as claimed in claim 9, wherein the lifting apparatus comprises one of (i) a hydraulic drive unit for power generation, (ii) a mechanical drive unit for power generation, (iii) an electrical drive unit for power generation and (iv) a pneumatic drive unit for power generation for power generation.

11. The carrying structure as claimed in claim 10, wherein the mechanical drive unit is a spindle.

12. The carrying structure as claimed in claim 10, wherein the hydraulic drive unit is a piston of a hydraulic cylinder.

13. The carrying structure as claimed in claim 9, wherein the lifting apparatus is arrangeable or arranged in one of (i) the blind hole or in the bore hole in the carrying structure, (ii) between the coupling element and the carriage body, (iii) within the coupling element and (iv) in a lower region of the carriage body.

14. The carrying structure as claimed in claim 1, wherein the coupling element is a secondary spring of the rail vehicle.

15. The carrying structure as claimed in claim 14, wherein the secondary spring is formed as one of (i) a hydraulic spring, (ii) a helical spring and (iii) a pneumatic spring.

* * * * *